United States Patent [19]

Gugliotta et al.

[11] 4,161,088

[45] Jul. 17, 1979

[54] PIPE-AND-BALL TRUSS ARRAY

[76] Inventors: Paul F. Gugliotta, 39 E. 20th St., New York, N.Y. 10003; David Hoffmann, 117 N. Jefferson St., Milwaukee, Wis. 53202

[21] Appl. No.: 850,646

[22] Filed: Nov. 11, 1977

[51] Int. Cl.[2] ..... E04B 1/56

[52] U.S. Cl. ..... 52/223 R; 52/461; 52/648; 403/176

[58] Field of Search ..... 52/81, 80, 461, 462, 52/223 R, 648; 403/176, 170, 171, 6, 7

[56] References Cited

U.S. PATENT DOCUMENTS

| | | | |
|---|---|---|---|
| 1,931,750 | 10/1933 | Blaski | 52/461 |
| 3,192,669 | 7/1965 | Hawkins | 52/81 |
| 3,488,961 | 1/1970 | Peterschmidt | 52/81 |
| 3,882,650 | 5/1975 | Gugliotta | 52/223 R |
| 3,916,589 | 11/1975 | Richter | 52/81 |

*Primary Examiner*—John E. Murtagh
*Attorney, Agent, or Firm*—Hubbell, Cohen, Stiefel & Gross

[57] ABSTRACT

An improved pipe-and-ball truss array for supporting a deck surface, such as a roof deck or a wall panel, thereon in a predetermined plane is provided in which the outer chord of the truss array comprises an outer hollow pipe element having a structural tee element extending radially outward from the outer surface thereof in a plane normal to the plane in which the deck surface is to be supported on the truss array and an inner rod running through the pipe along the longitudinal axis thereof. A hollow substantially ball-like member, such as a hollow spherical member, is provided which is common to a plurality of truss members which truss members are joined to the spherical member by bolting. The structural tee element comprises a radially extending portion and a first planar extending portion normal thereto, with the first planar extending portion extending in a plane parallel to the deck surface supporting plane and being capable of structurally supporting the deck surface thereon above the outer hollow pipe element. The outer hollow pipe elements which have such radially extending structural tee elements are structurally stronger in bending than the outer hollow pipe elements which do not and preferably extend in a direction normal to the direction in which the deck surface to be supported runs. The structural tee element may also include a second planar extending portion disposed above and spaced from the first planar extending portion and extending in a plane parallel thereto for supporting the deck surface between the first and second planar extending portions. The deck surface can thereby be readily supported on the improved truss array, which is an improvement on the array disclosed in commonly owned U.S. Pat. No. 3,882,650.

27 Claims, 11 Drawing Figures

PIPE-AND-BALL TRUSS ARRAY

CROSS-REFERENCE TO RELATED APPLICATIONS

This application is an improvement on the pipe-and-ball truss array described in the commonly owned previous U.S. Pat. No. 3,882,650, issued May 13, 1975.

BACKGROUND OF THE INVENTION

1. Field of the Invention

The present invention relates to pipe-and-ball truss arrays such as the type utilized for space trusses and space frames.

2. Description of the Prior Art

Space frames are well known in the art, such as the type normally known as pipe-and-ball space frames. Prior art space frames of this type, that is prior to the space frame described and claimed in commonly owned U.S. Pat. No. 3,882,650 by Paul F. Gugliotta, such as disclosed in British Pat. No. 1,206,399, have utilized threaded pipes which thread into the ball joints or have been of the type utilizing pipes which are welded to the ball joints. Both of these types of interconnections are costly. Some other prior art space frames, such as the structure utilized for the Polish Pavillion in the International Exhibition in Brussels in 1958, utilize tension elements, such as flexible rods, which are bolted within a hollow ball joint or sphere by nuts which are tightened to place these elements in tension, in conjunction with separate reinforced concrete members which are placed in compression. This is a costly arrangement and, furthermore, the tension elements may not be utilized where compressive loads occur nor are the concrete elements usable where tensile loads occur. Thus, such prior art pipe-and-ball truss arrays, such as employed in space frames, have not economically satisfactorily provided higher strength or resistance to compressive, tensile and axial loads without increased costs. Other prior art arrangements for use in connection with space frames are disclosed in U.S. Pat. Nos. 3,220,152; 3,632,147; and 3,789,562, as well as in French Pat. Nos. 1,073,078 and 1,489,468.

Such disadvantages of the prior art, it is believed, were overcome by the pipe-and-ball truss array described and claimed in commonly owned U.S. Pat. No. 3,882,650. However, with respect to the pipe-and-ball truss array described in that patent, there are possible disadvantages when it is desired to employ such a truss array in connection with the support of a deck surface, such as a roof deck or a wall panel, thereon. Primarily, the disadvantage flows from the fact that the pipe elements employed in such a pipe-and-ball truss array are normally not strong enough in bending to adequately support such a deck surface and, moreover, provide a relatively small area for attachment of the deck surface to the outer chords of the truss array. Although U.S. Pat. No. 3,882,650 discloses a system for attaching a skylight structure to the array by means of bolting to the hollow spheres, this arrangement is not preferred for supporting a deck surface on the array as adequate support may not be provided. Moreover, as previously mentioned, such deck surface cannot be adequately supported directly on the pipe elements forming the outer chord of such an array since such pipe elements are not sufficiently strong in bending. These disadvantages of the prior art are overcome by the present invention.

SUMMARY OF THE INVENTION

An improved pipe-and-ball truss array is provided which comprises a plurality of truss members, at least a first hollow substantially ball-like member portion, such as a hollow spherical member, such as a hemisphere or a substantially unitary sphere, common to the plurality of truss members and first means, such as bolting means, for joining the plurality of truss members to the first spherical member portion. Each of the truss members comprises an outer hollow pipe element having an longitudinal axis and first and second ends, and an inner rod element extending through the outer hollow pipe element along the longitudinal axis. In the improved pipe-and-ball truss array, at least one of the outer hollow pipe elements further comprises a structural tee element extending radially outward from the outer surface of such outer hollow pipe elements in a plane normal to the plane in which the deck surface is to be supported on the truss array. The structural tee element comprises a radially extending portion and a first planar extending portion normal thereto with the first planar extending portion extending in a plane parallel to the deck surface supporting plane and being capable of structurally supporting the deck surface thereon above the outer hollow pipe element outer surface. This outer hollow pipe element having the radially extending structural tee element is structurally stronger in bending, such as almost twice as strong, than the other outer hollow pipe elements alone, that is those not having a structural tee element, whereby the deck surface is structurally supported in the truss array on the structural tee element bearing pipe element. The structural tee elements may also include a second planar extending portion disposed above and spaced apart from the first planar extending portion extending in a plane parallel thereto with the deck surface to be supported disposed therebetween, such as for supporting glass decking. Normally, the supported deck surface runs in an associated direction with respect to the truss array and the outer hollow pipe elements which have the radially extending structural tee elements radially extending therefrom preferably solely extend in a direction normal to the deck surface associated direction. Preferably, the first planar extending portion is disposed above the substantially ball-like member portion exterior surface whereby the deck surface is structurally supported in the truss array solely on the structural tee element bearing pipe elements on the first planar extending portions thereof.

With respect to the pipe-and-ball truss array truss members in general, the inner rod elements each have first and second ends and the first spherical member portion, assuming the substantially ball-like member portion is a spherical member portion, has a plurality of spaced apart apertures extending from the exterior surface thereof to the interior thereof. Each of the inner rod elements first ends extend beyond the outer hollow pipe element first end and through an associated one of the apertures in the first spherical member portion, this end having threads thereon. Each of the outer hollow pipe element first ends bears against the first spherical member portion exterior surface. The first joining means comprises first threadable nut means threadably mounted in the first spherical member portion interior on the inner rod element threaded first ends and bearing against the interior surface of the first spherical member portion for simultaneously placing the inner rod element of the truss member in tension and the outer hollow pipe element of the same truss member in compression, whereby applied tensile, compressive and axial forces are transferable between the joined truss members through the first spherical member.

Similarly, other hollow spherical members are provided and the truss members are interconnected therebetween with the inner rod element of an associated truss member which spans between two spherical members being bolted at the extremities within the spherical members so as to place the rod in tension and the outer hollow pipe element portion of the truss member which bears against the exterior surface of the spherical members simultaneously being placed in compression so that the truss member may carry applied tensile, compressive and axial forces and transfer these forces between truss members which are joined to spherical members through the spherical members, such as to a support for the truss array. The truss array may be a two dimensional space truss or a three dimensional space frame which may be formed from a plurality of interconnected truss modules, such as a triangular module comprising three spherical members and three truss members interconnected therebetween or a three dimensional module, such as a rhomboid, parallelipiped, cube or pyramid.

If the spherical member is formed from two hemispheres which are bolted together, each hemisphere may contain additional truss members bolted thereto so as to increase the number of available truss members in a given arrangement compared to when substantially unitary members are utilized, such unitary members preferably having an opening therein through which the nuts may be threadably tightened on the inner rod elements to bolt the truss members to the spherical member. The inner rod element preferably extends through spacer elements, such as washers located within the interior of the outer hollow pipe element and is supported therein by these spacer elements.

If desired, since all of the truss members do not carry the same compressive, tensile or axial loads in a truss array, different size truss members may be utilized dependent on the type and value of the load to be carried thereby. For example, either the inner or outer diameter of the outer hollow pipe element for one truss member may be different from another truss member if the truss member is to carry a different compressive load than the other truss member or the diameter of the inner rod element may be different from that of another truss member if the truss member is to carry a different tensile load than the other truss member, these different size truss members being joined to a common spherical member for transfer of the compressive, tensile and axial forces between the different size joined truss members through the spherical member. With respect to varying the inner diameter of the outer hollow pipe element while maintaining the outer diameter thereof constant so as to vary the thickness, the truss array may be aesthetically uniform while structurally being arranged to compensate for different compressive loads required by different truss members. The outer hollow pipe elements may be formed from a material selected from the group consisting of steel, aluminum, concrete, wood, fiberglass and plastic, the spherical member may preferably be formed from a material collected from the same group of materials and the inner rod element may preferably be formed from a material selected from the group consisting of steel, aluminum, wood, fiberglass and plastic, the resultant truss member, if desired, being formed from like materials or a mixture of these materials; however, the inner rod element not being formed from concrete as concrete is not highly resistant to the tensile loads to be carried by the inner rod element.

DETAILED DESCRIPTION OF PREFERRED EMBODIMENTS

Figure 10:
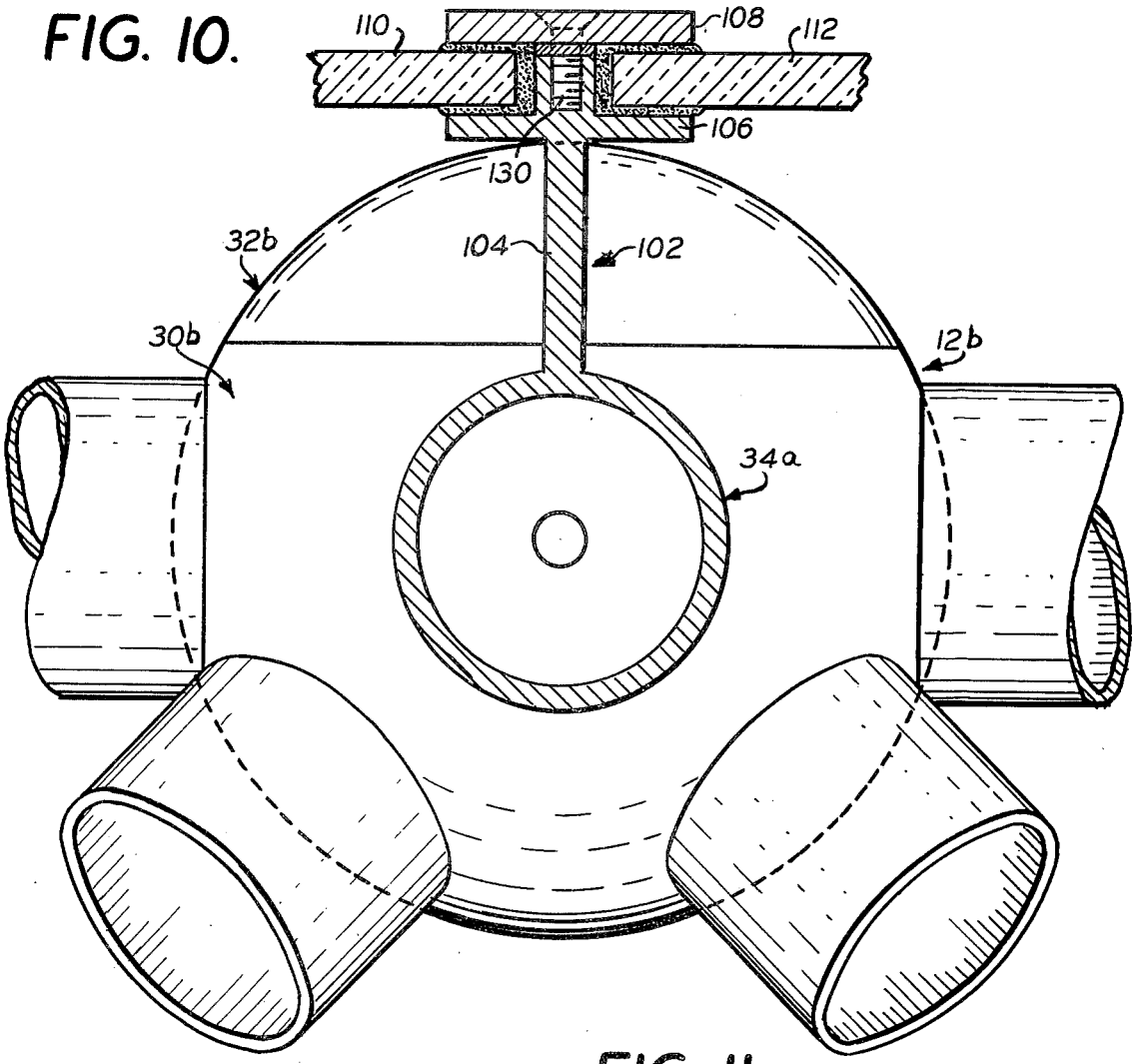
FIG. 10 is a fragmentary perspective view, partially in section, similar to FIG. 5 showing an alternative embodiment of the preferred outer chord element and ball-like member portion.
Figure 11:
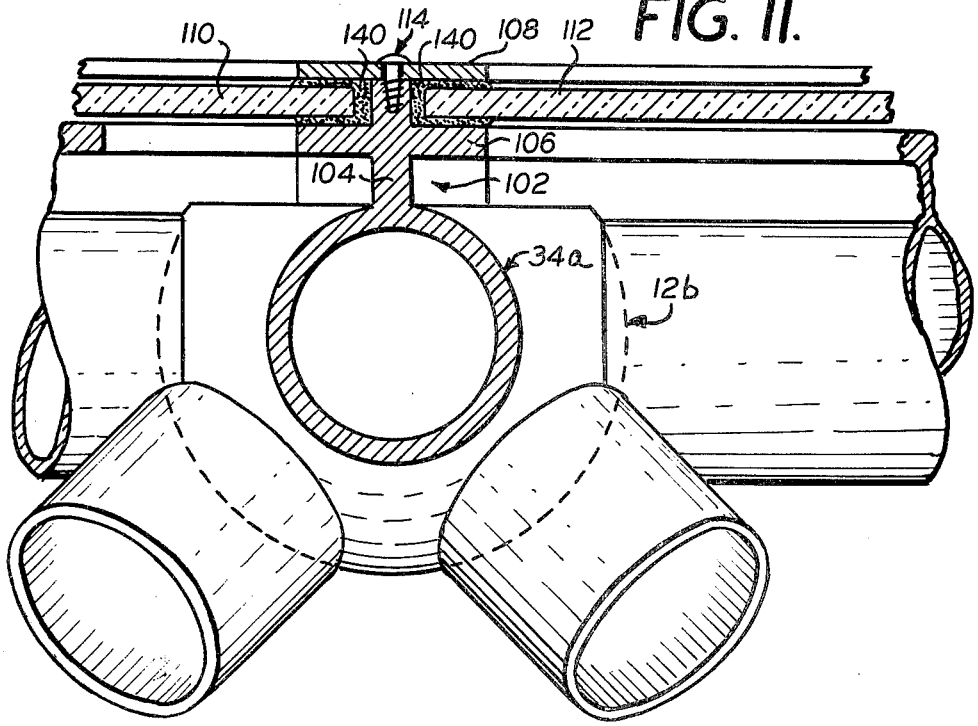
FIG. 11 is a fragmentary perspective view, partially in section, similar to FIG. 10 of another alternative embodiment of the preferred outer chord element and ball-like member portion of the embodiment shown in FIG. 5.

Before referring to the drawings in detail, it should be noted that preferably FIGS. 1, 2, 8 and 9 are identical with FIGS. 1, 2, 4 and 5, respectively, of commonly owned U.S. Pat. No. 3,882,650 since the pipe-and-ball truss array to be described herein is an improvement on the pipe-and-ball truss array described in U.S. Pat. No. 3,882,650, with the improvement preferably residing in the outer chord element of the truss array upon which a deck surface, such as a roof deck or a wall panel, is to be supported, such as shown in FIGS. 3 through 7, 10 and 11. In addition, before describing the drawings in detail, it should be noted that as used hereinafter throughout the specification and claims, a substantially ball-like member is meant to include a spherical member as well as variations thereof which are not complete spheres such as shown in FIGS. 10 and 11. However, the principle of operation of a spherical member in the preferred pipe-and-ball truss array is preferably identical with that of the other substantially ball-like members shown in FIGS. 10 and 11.

Figure 1:
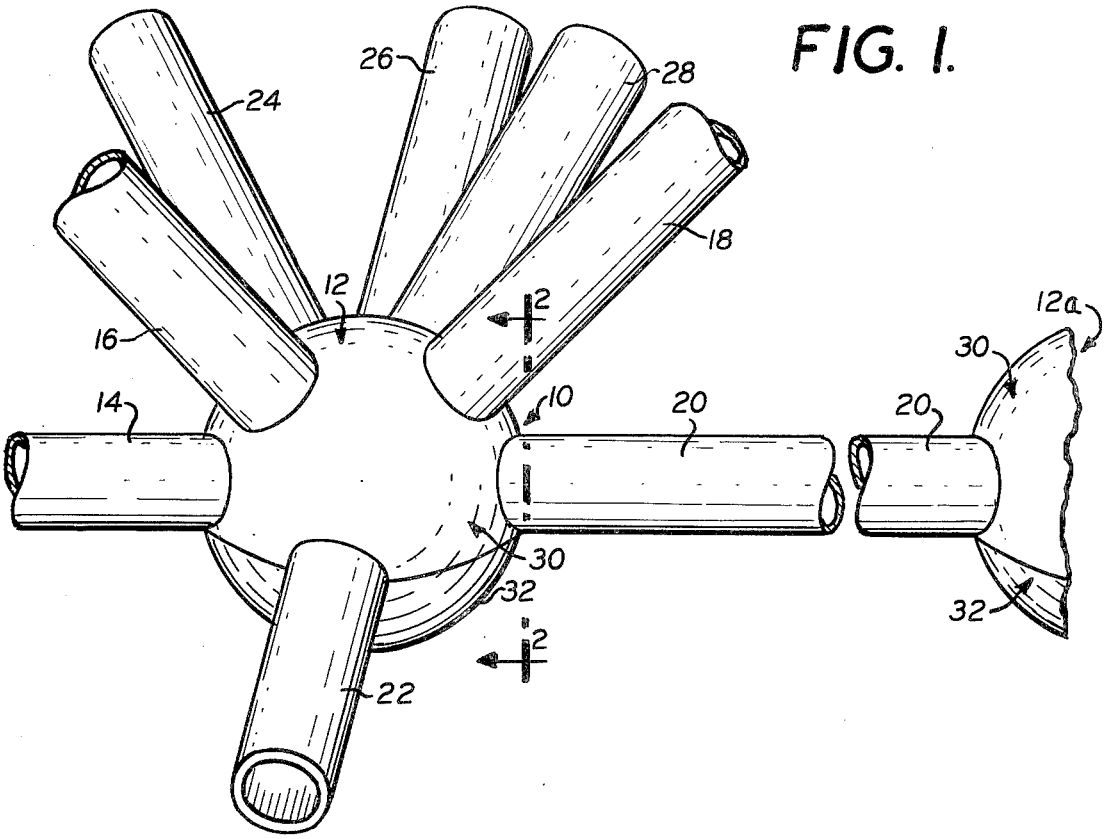
FIG. 1 is a fragmentary perspective view of a typical preferred pipe-and-ball joint in the preferred improved pipe-and-ball truss array.
Figure 2:
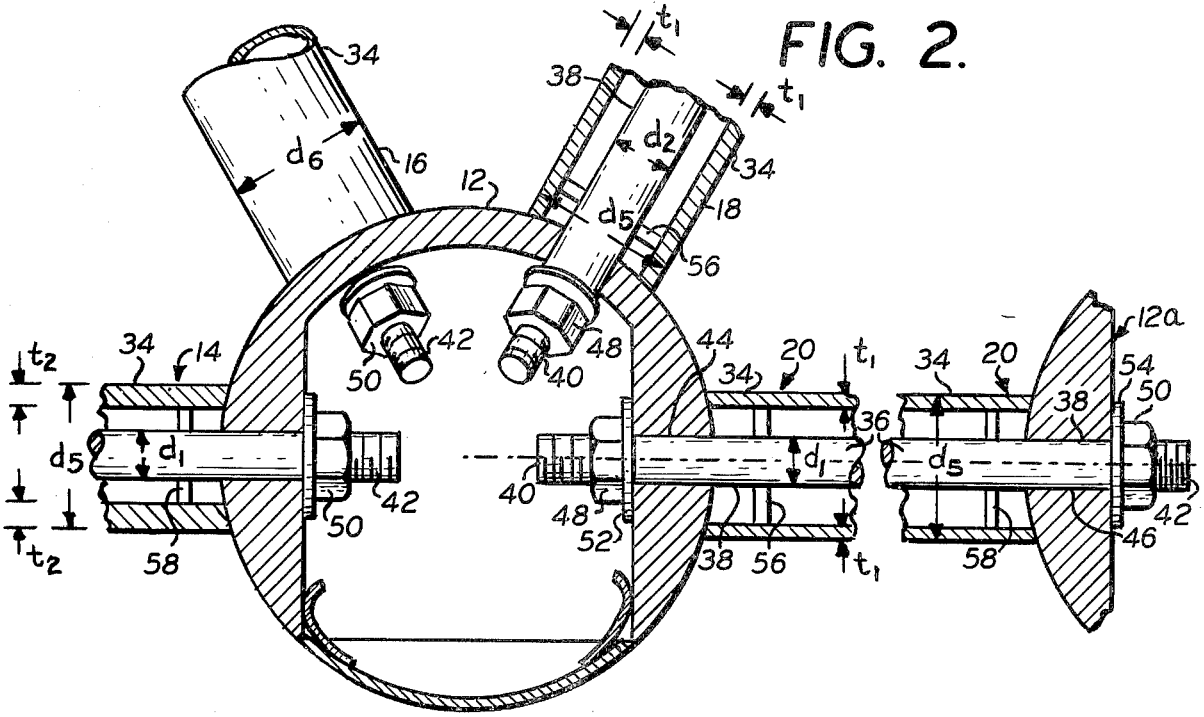
FIG. 2 is a fragmentary sectional view taken along line 2—2 of the embodiment shown in FIG. 1.

Referring now to the drawings in detail and initially to FIGS. 1 and 2, a typical preferred pipe-and-ball joint of the preferred pipe-and-ball truss array, such as the type described and claimed in U.S. Pat. No. 3,882,650, is shown. The joint generally referred to by the reference numeral 10 preferably comprises a hollow ball or sphere 12 to which a plurality of truss members are joined, preferably by bolting, in a manner illustrated in FIG. 2 and to be described in greater detail hereinafter, eight such truss members 14, 16, 18, 20, 22, 24, 26 and 28 being shown by way of example in FIG. 1. The ball or sphere 12 preferably comprises a pair of sections 30 and 32 with section 30, as illustrated in FIG. 1, preferably being the section or portion to which the truss members 14 through 28, inclusive, are joined and section 32 merely being a removable cover which enables access to the interior of the sphere 12 as illustrated in FIG. 2. The truss members 14 through 28, inclusive, are preferably designed, as will be described in greater detail hereinafter, to carry both compressive, tensile and axial loads, these forces being transferable between the joined truss members through the ball or sphere 12, as will be described in greater detail hereinafter.

As shown and preferred in FIG. 2, a typical preferred truss member 20 preferably comprises an outer hollow pipe or tubular member 34 having a longitudinal axis 36 and an inner rod element 38 which preferably extends through the center of the outer hollow pipe element 34 along the longitudinal axis 36 thereof. As also shown and preferred in FIG. 2, the ends 40 and 42 of the inner rod element 38 are threaded and extend beyond the ends of the outer pipe element 34 a sufficient distance so as to be insertable into the interior of the spheres 12 and 12*a*, respectively, through apertures 44 and 46, respectively, therein. The length of the inner rod element 38 is preferably a sufficient length to enable these ends 40 and 42 to extend into the interior of the spheres 12 and 12*a*, respectively, a sufficient amount to enable threading of a nut 48 and 50, respectively, thereon to bolt the inner rod element 38 to the spheres 12 and 12*a*, respectively. As shown and preferred, washers 52 and 54, respectively, are placed between the nut 48 and 50, respectively, and the interior surface of the sphere 12 and 12*a*, respectively. Spacer means, such as washers 56 and 58, respectively, are preferably located near the ends of the outer pipe element 34 for supporting the inner rod element 38 in position in the outer pipe element 34 of the truss member 20, the washers 56 and 58 having an aperture therein through which the inner rod element 38 passes. If desired, additional washers may be placed along the length of the inner rod element 38 within the interior of the outer hollow pipe element 34 for added support.

In utilizing the preferred typical joint of FIG. 1 in a pipe-and-ball truss array, the cover 32 of the sphere 12 is initially removed. A typical truss member, such as truss member 20, which preferably comprises the outer hollow pipe element 34 whose ends may preferably be mere cut lengths of structural pipe, and the inner rod element 38 which is supported within the interior of the outer hollow pipe element 34 by washers 56 and 58, is then aligned between two spheres, 12 and 12*a* in the example shown, to which it is to be joined for transferring compressive, tensile and axial loads therebetween, with the inner rod element 38 having the ends 40 and 42, respectively, passing through apertures 44 and 46, respectively, in the spheres 12 and 12*a*, respectively. Nuts 48 and 50 are then tightened, such as by inserting a wrench through the opening provided by the removal of cover 32, with washers 52 and 54 preferably between the nuts 48 and 50, respectively, and the interior of the spheres 12 and 12*a*, respectively. These nuts 48 and 50 are tightened a sufficient amount to preferably place the inner rod element 38, which is preferably a flexible rod, in tension with a desired tensile load thereon while simultaneously placing the outer hollow pipe element 34 in compression between the two spheres 12 and 12*a*, the ends of outer pipe element 34 bearing against the exterior surface of the spheres 12 and 12*a*. Thus, by tightening of the nuts 48 and 50 joining the truss member 20 to the spheres 12 and 12*a*, the inner rod element is placed in tension while, simultaneously the outer pipe element is placed in compression, the truss member 20 thereby being able to carry compressive as well as tensile and axial loads. The same procedure is repeated for all of the truss members 14 through 28, inclusive, connecting the truss members between sphere 12 and associated spheres located at the opposite end of the respective truss members 14 through 28, inclusive, so that each of the truss members 14 through 28 is capable of carrying compressive, tensile and axial loads, these forces being transferable between the truss members through the spheres.

Figure 3:
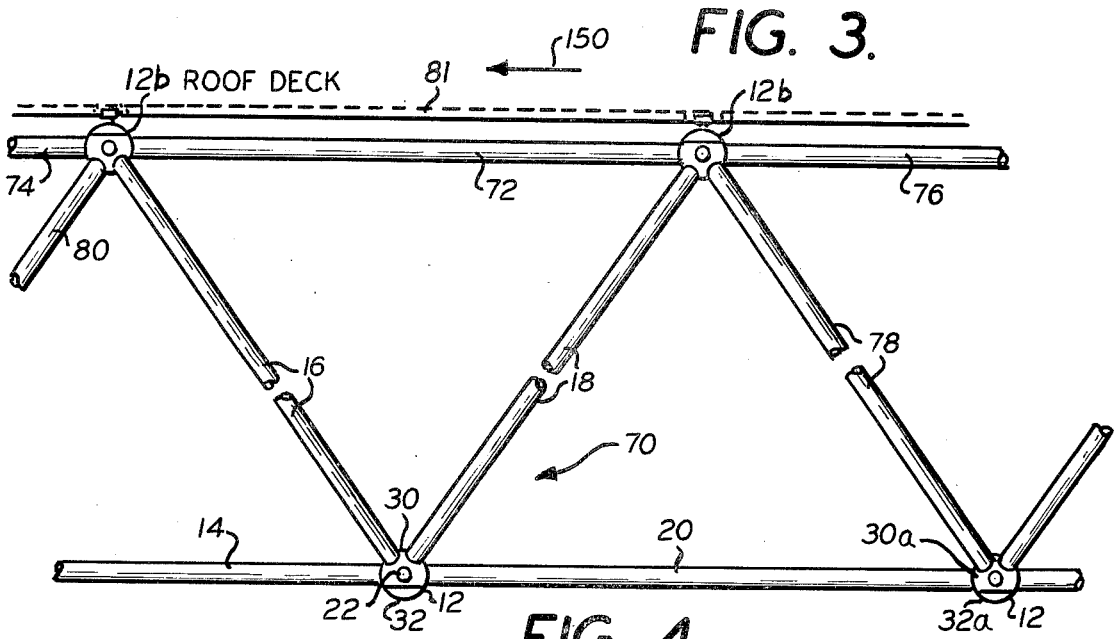
FIG. 3 is a fragmentary side elevation of a typical improved pipe-and-ball truss array utilizing the preferred joint of FIG. 1 and the preferred improved pipe element for the outer chords of the array.

Referring now to FIG. 3, a typical pipe-and-ball truss array, generally referred to by the reference numeral 70, is shown, the truss array 70 comprising a plurality of truss modules which are, by way of example, triangular for a two dimensional space truss or pyramidal for a three dimensional space frame. The configuration illustrated in FIG. 3 is only shown by way of example and any other type of truss array, such as a space frame having truss modules which are rhomboids, parallelipipeds, or cubes may be constructed utilizing the pipe-and-ball joint of the present invention. In the arrangement illustrated in FIG. 3, assuming the truss module is utilized to construct a two dimensional space truss, wherein the truss module is triangular, or assuming the truss module is a pyramid utilized to construct a three dimensional space frame with the truss members being shown only in one plane for purposes of clarity, truss member 16 extends between spheres 12 and 12*b*, truss member 18 extends between spheres 12 and 12*c*, and a truss member 72, which forms the outer chord of the array 70 and which preferably comprises the improved hollow pipe element 34*a* having a structural tee 100 or 102 (FIGS. 7 and 5, respectively) radially extending therefrom for supporting a deck surface 80 thereon, extends between spheres 12*b* and 12*c* to form one face of the pyramidal truss module if the array is a three dimensional space frame or to form a triangular module if it is a two dimensional space truss. Each of the truss members 16 and 18 is preferably identical in configuration with that previously described with reference to the typical truss member 20, as is truss member 72 except for the structural tee 100 or 102; that is, the truss member preferably consists of an outer hollow pipe element similar to pipe element 34 except for pipe element 34*a* of truss member 72 which includes the structural tee 100 or 102, which structural tee 100 or 102 is preferably not present in connection with the general typical element 34, and an inner rod element similar to rod element 38 which is supported within the interior of the outer element 34 by washers 56 and 58, with the inner rod element 38 having threaded ends 40 and 42 upon which nuts 48 and 50 are threaded within the interiors of the respective spheres 12, 12*b* and 12*c*. Thus, truss member 18 is connected between spheres 12 and 12*c* and joined to these spheres by tightening of a nut 48 on end 40 of the inner rod element of truss member 18 within sphere 12 and nut 50 on the other end 42 of the inner rod element 38 of truss member 18 within sphere 12*c* so as to place the inner rod element of truss member 18 in tension while simultaneously placing the outer pipe element 34 of truss member 18 in compression between the two spheres 12 and 12*c* with the ends of truss member 18 bearing against the exterior surface of spheres 12 and 12*c*. Similarly, the ends of the inner rod element 38 of truss member 16 and the inner rod element 38 of truss member 72 extend into the interiors of spheres 12 and 12*b*, and 12*b* and 12*c*, respectively, and are bolted in place by means of nuts 48 and 50 within the interiors of these respective spheres to place the inner rod elements of the truss members 16 and 72, respectively, in tension while simultaneously placing the hollow pipe elements 34 and 34*a*, respectively, of these truss members 16 and 72, respectively, in compression between the respective spheres 12 and 12*b*, and 12*b*, and 12*c*, with the ends of the truss members 16 and 72 bearing against the exterior surface of spheres 12 and 12*b*, and 12*b* and 12*c*, respectively. Accordingly, compressive, tensile and axial loads may be transferred between the various truss members 16, 18, 72, 14 and 20, as well as any other truss members connected to the spheres 12, 12*b* and 12*c* through these spheres. These loads may then be transferred to the supports for the truss array (not shown). Truss members 74 and 76 are preferably identical with truss member 72.

Referring once again to FIGS. 2 and 3, if desired the truss members 14 through 28, 72, 74, 76 and 78 illustrated in FIGS. 2 and 3 may all be of the same dimension, except for the structural tee elements 100 or 102 of trus members 72, 74 and 76; that is, the outer diameters of outer pipe elements 34 or 34*a* (except for the structural tee element 100 or 102) may all be the same, the thickness of the outer pipe elements 34 and the diameters of the inner rod elements 38 may all be the same, with the parameters being selected for the worst case load condition. However, such a worst case condition is normally present only in a relatively small percentage of truss members, such as one percent or less, of a truss array. Accordingly, as shown and preferred in FIGS. 2 and 3, the parameters of the respective truss members may be varied so as to be chosen dependent on the compressive, tensile and/or axial load to be carried by the particular truss member, the narrower the diameters or thickness of the outer pipe and inner rod elements comprising the truss member, the less the load to be carried and the greater the diameter or thickness of the outer pipe 34 or 34*a* (except for structural tee portions 100 or 102) and inner rod elements 38 of the truss member, the greater the load to be carried. For example, as illustrated in FIG. 2, assuming truss members 14 and 20 are to carry different compressive loads, truss member 14 carrying a greater compressive load than truss member 20, and, assuming it is desired to have a constant outer diameter or pipe size for the truss members, such as 14 and 20, for aesthetics, then the thickness $t_2$ of outer hollow pipe element 34 is preferably increased, the thickness $t_2$ of the outer pipe element 34 of truss member 14 being greater than the thickness $t_1$ of outer pipe element 34 of truss member 20 by a selected amount which may be conventionally chosen so as to allow for the relative compressive loads to be carried by truss members 14 and 20. The outer diameter $d_5$ of the outer pipe elements 34 of truss members 14 and 20, in this example, preferably being identical and the diameter $d_1$ of the inner rod elements 38 of truss members 14 and 20, in this example, preferably being identical. Assuming that truss members 16 and 20 are also to carry different compressive loads, with truss member 16 carrying a greater compressive load than truss member 20, the thickness of outer pipe element 34 as well as the diameter $d_1$ of the inner rod element 38 may be identical and the outer diameter $d_6$ of outer pipe element 34 of truss member 16 could be made greater than the outer diameter $d_5$ of outer pipe element 34 of truss member 20 a sufficient amount, selected in conventional fashion, to allow for the relative compressive loads to be carried by truss members 16 and 20. Lastly, in the example shown in FIG. 2, assuming that truss members 18 and 20 are to carry different tensile loads, and assuming that outer pipe element 34 of truss member 18 and outer pipe element 34 of truss member 20 have the same thickness $t_1$ and outer diameters $d_5$, the diameter $d_2$ of inner rod element 38 of truss member 18 could preferably be made greater than the diameter $d_1$ of inner rod element 38 of truss member 20 if the tensile loads to be carried by truss member 18 are greater than the tensile loads to be carried by truss member 20. The opposite variations in these parameters could be accomplished if the compressive and/or tensile loads are to be less than that carried by truss member 20 as opposed to greater, as in the example given. Of course, any combination of these, such as an increased diameter for the inner rod element and a greater outer diameter for the outer pipe element, or any other combination, may be accomplished in order to adjust for variations in the compressive and/or tensile loads to be carried by the various truss members since, as is well known, in a typical truss array, loads in an individual truss member may vary from maximum tension to maximum compression along the length of the truss array. Accordingly, as shown and preferred in FIG. 2, many different size inner rod elements 38 and different size outer pipe elements 34 may be connected to a common sphere 12, with the size preferably being determined by the load to be carried by the particular truss member either in tension, compression or shear. It should be noted that the size or diameter of the sphere 12 is preferably determined by the size of the outer pipe elements 34, the size of the inner rod elements 38 and the loads to be carried, a larger sphere 12 being utilized where larger loads are to be carried. The selection of the sizes of the elements comprising the truss members as well as the sizes of the various spheres may be accomplished in conventional fashion based on a conventional load analysis for the truss array.

Figure 4:
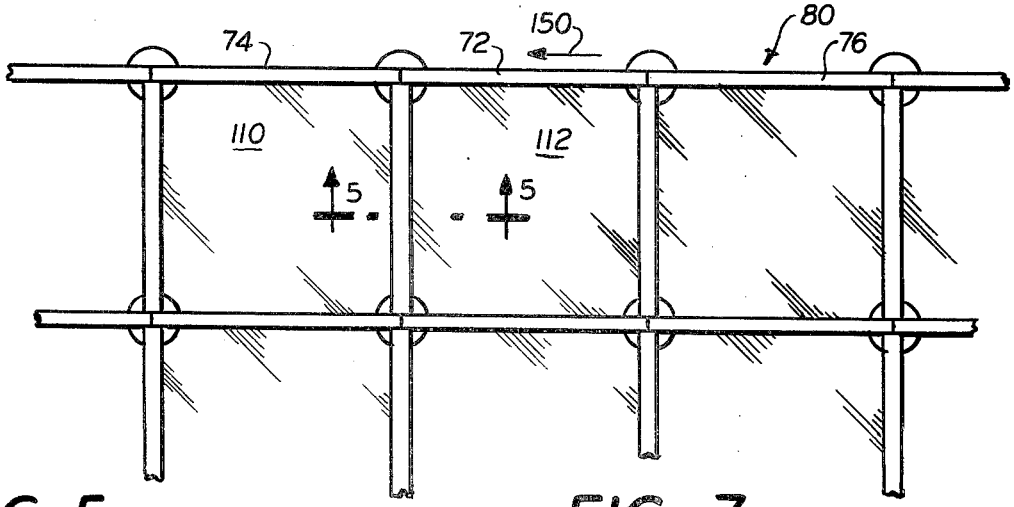
FIG. 4 is a plan view of the preferred embodiments of the improved pipe-and-ball truss array of FIG. 3.
Figure 5:
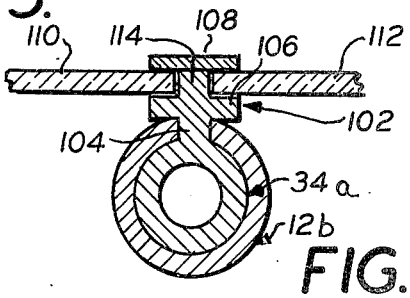
FIG. 5 is a fragmentary sectional view taken along line 5—5 of the embodiment shown in FIG. 4 for supporting a glass type deck surface on the array.

Referring now to FIGS. 3, 4 and 5, a typical preferred outer chord element and improved pipe-and-ball truss array in accordance with the present invention is shown. In the embodiment shown in FIG. 4, the pipe-and-ball truss array is shown as supporting glass roof panels. Thus, the outer chord elements 72, 74 and 76, by way of example, of the truss array 70 are shown in plan in FIG. 4 and in a fragmentary sectional view in FIG. 5. As shown and preferred in FIG. 5, the spherical ball 12*b* is shown with outer hollow pipe element 34*a* extending therefrom. As shown in FIG. 5, outer pipe element 34*a* preferably includes a structural tee element 102 radially extending outwardly from the outer surface thereof. The structural tee element 102 preferably includes a radially extending portion 104 and a first planar extending portion 106 which extends normal to portion 104 so as to in effect form the cross of a tee. In addition, as shown and preferred in FIG. 5, a second planar extending portion 108 is provided which is disposed on radially extending portion 104 spaced apart from and parallel to portion 106. The glass panels 110 and 112, by way of example, are supported between portions 102 and 108 and rest on portion 102. As further shown and preferred in FIG. 5, portion 108 is separate from portion 104 and is mounted thereto by fastening means, such as conventional self-taping screws 114 during assembly, after the glass panels 110 and 112, by way of example, have been supported on portion 102. Thereafter, caulking is preferably provided to seal the joint and, the glass panels 110 and 112 may be glazed with a silicone sealant. The structural tee element 102 of FIG. 5, as is true of the structural tee element 100 of FIG. 7, is preferably stronger in bending then the hollow pipe element 34 by itself, such as preferably twice as strong, thereby providing significantly better support for the deck surface 80, such as the deck surface comprised of glass panels 110 and 112, by way of example.

Figure 7:
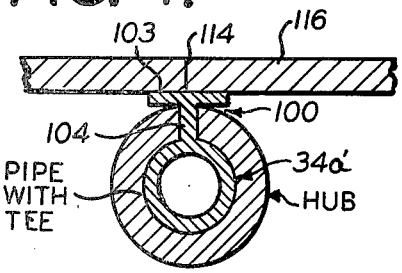
FIG. 7 is a fragmentary sectional view similar to FIG. 5 taken along line 7—7 in FIG. 6 of an alternative embodiment of a typical preferred outer chord pipe element employed in the arrangement of FIG. 6.
Figure 6:
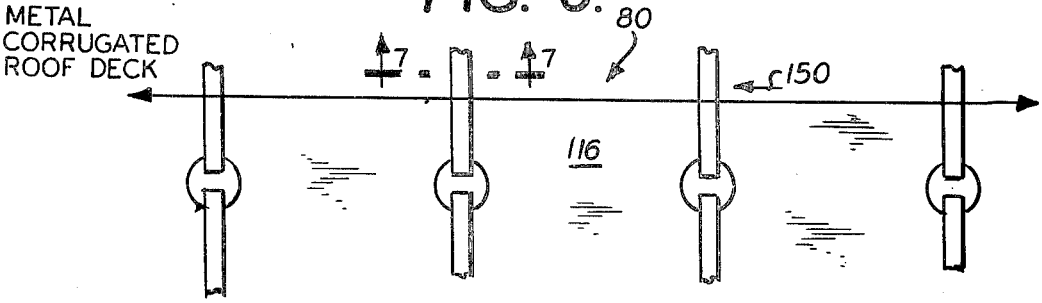
FIG. 6 is a plan view similar to FIG. 4 showing an alternative embodiment of the preferred outer chord pipe elements for supporting a metal corrugated roof deck, by way of example, on the array.

Referring now to FIGS. 6 and 7, an alternative embodiment of the preferred outer chord pipe element 34*a*, referred to by reference numeral 34*a'*, is shown. The arrangement of FIGS. 6 and 7 is preferably employed for supporting non-breakable materials, such as a metal corrugated roofing deck, with the primary difference being in the structural tee element 100 which comprises only a single planar extending portion 102 extending normal to radially extending portion 104 as opposed to also including a second planar extending portion 108. As the arrangement of FIG. 5, the metal corrugated roof deck 116 comprising roof deck 80 is preferably mounted to the planar extending portion 102 by means of self-tapping screws 114.

Referring now to FIGS. 10 and 11, alternative embodiments of the arrangement shown in FIG. 5 are shown. With respect to FIG. 10, a fragmentary perspective view, partially in section, similar to FIG. 5 is shown. In the embodiment of FIG. 10, the structural tee 102 is preferably formed of an extruded aluminum comprising portions 104 and 106 with portion 108, which comprises an outside stop, preferably being formed of glass in the example where it is desired to support glass decking 110, 112, by way of example. As further shown and preferred in FIG. 10, the glass stop member 108 is mounted or secured to the upstanding portion 104 of the structural tee 102 by screws, such as conventional CSK screws 130. Thus, in FIG. 5, portion 108 is preferably formed of the same structural material as the other portions 104 and 106 of the structural tee whereas in FIG. 10, portion 108 is formed of glass. Moreover, as shown and preferred in FIG. 10, ball 12*b*, as is true of ball 12 previously described with reference to FIG. 1, comprises a pair of sections 30*b* and 32*b*, with section 32*b* comprising the cover of the sphere or ball 12*b*. In addition, the caulking and other sealants previously referred to with respect to FIG. 5 are also preferably employed with respect to the embodiment shown in FIG. 10.

With respect to the embodiment of FIG. 11, this embodiment is preferably substantially identical with that previously described with reference to FIG. 5. As shown and preferred in FIG. 11, portion 108 of the structural tee preferably forms an aluminum cap whereas the balance of the structural tee, that is portions 104 and 106 are preferably formed as an extruded space frame member. As also shown and preferred in FIG. 11, the aluminum cap 108 is preferably secured to portion 104 of the structural tee 102 by means of conventional self-tapping screws 114. However, as opposed to the continuous slot referred to with reference to FIG. 5 which forms a pilot hole for the self-tapping screws 114, if desired these screws 114 can be driven directly into the structural tee portion 104 in conventional fashion if such structural tees are provided without a continuous slot, such as in the arrangement of FIG. 11. In addition, FIG. 11 shows the positioning of the caulking 140 previously referred to with reference to FIGS. 5 and 10. In addition, as was true with reference to FIGS. 5 and 10, the glass panels 110 and 112, by way of example, are also preferably glazed with a silicone sealant.

Thus, FIGS. 5, 10 and 11 show typical preferred arrangements for supporting glass decking in a pipe-and-ball truss array whereas FIG. 7 shows a typical preferred arrangement for supporting standard steel decking, such as a metal corrugated roof deck, in such a pipe-and-ball truss array. With respect to the standard steel decking, such decking 116 may be attached to portion 103 of structural tee 100 by a conventional tack weld or by the aforementioned self-tapping screws 114. Moreover, as shown and preferred in FIGS. 3, 4 and 6, the decking 80 preferably runs in a predetermined direction, such as indicated by arrow 150 by way of example, with the decking 80 being supported on the aforementioned structural tee arrangements preferably in a direction normal to the direction 150 in which the decking 80 runs.

Figure 8:
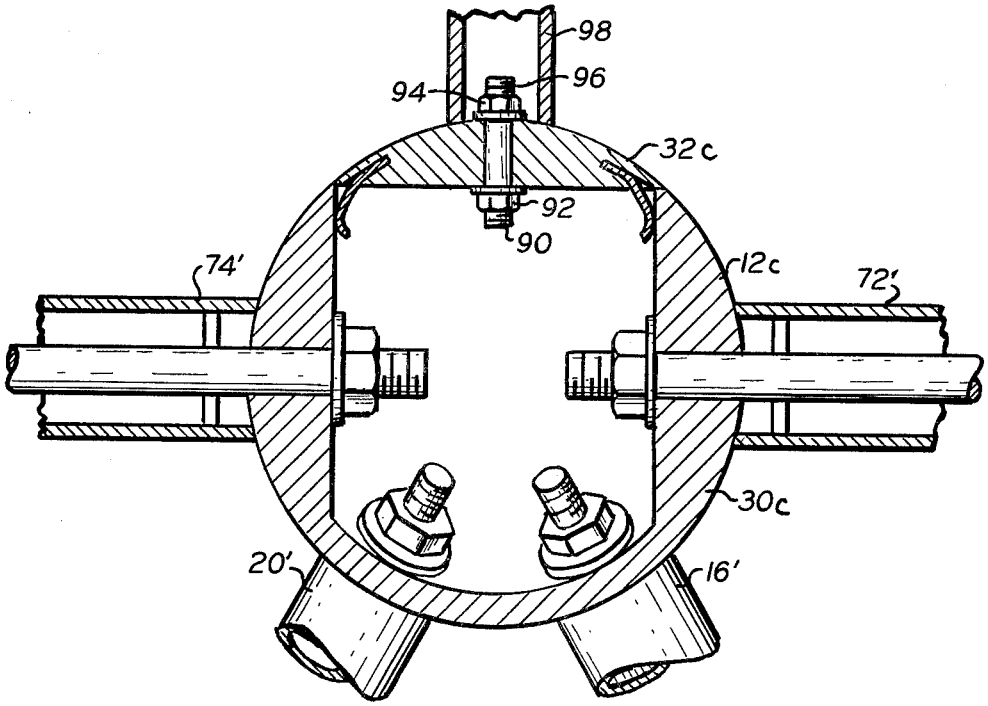
FIG. 8 is an alternative embodiment of the arrangement illustrated in FIG. 2 illustrating the prior art arrangement disclosed in U.S. Pat. No. 3,882,650 for supporting an element above or below the truss array.

Referring now to FIG. 8, a modification of the joint previously described with reference to FIG. 2 is shown. The joint illustrated in FIG. 8 is preferably identical with that previously described in commonly owned U.S. Pat. No. 3,882,650 as being for supporting a skylight above or below the truss array 70, with such support being provided by means of attachment to sphere 12*c*. Although, as previously described, such an arrangement is not preferred with respect to the support of deck surfaces, such as roof decking 80, it is sufficient for supporting a skylight above the truss array 70. Thus, as described in U.S. Pat. No. 3,882,650, in order to support a skylight above the truss array 70, an aperture may be provided in the cover portion 32*c* of the sphere 12*c* through which a threaded bolt 90 may be passed. Nuts 92 and 94 may be tightened on the end of the bolt 90, with the end 96 of the bolt 90 extending outside of the cover portion 32*c* of the sphere 12*c* into an attachment housing 98 for the skylight structure (not shown), which attachment housing 98 is then bolted to the spheres 12*c* by means of nut 94 and bolt 90. A cover portion 32*c* of the sphere 12*c* may be secured to the other portion 30*c* of the sphere 12*c* in any conventional fashion, such as by bolting (not shown). Moreover, in the arrangement of FIG. 8, pipe element 74', 72', 16' and 20' are assumed to replace corresponding pipe element 74, 72, 16 and 20 in the arrangement of FIG. 3, with the roof deck 81 in the arrangement of FIG. 3 being replaced by a conventional skylight (not shown) which is to be supported above the truss array 70.

Figure 9:
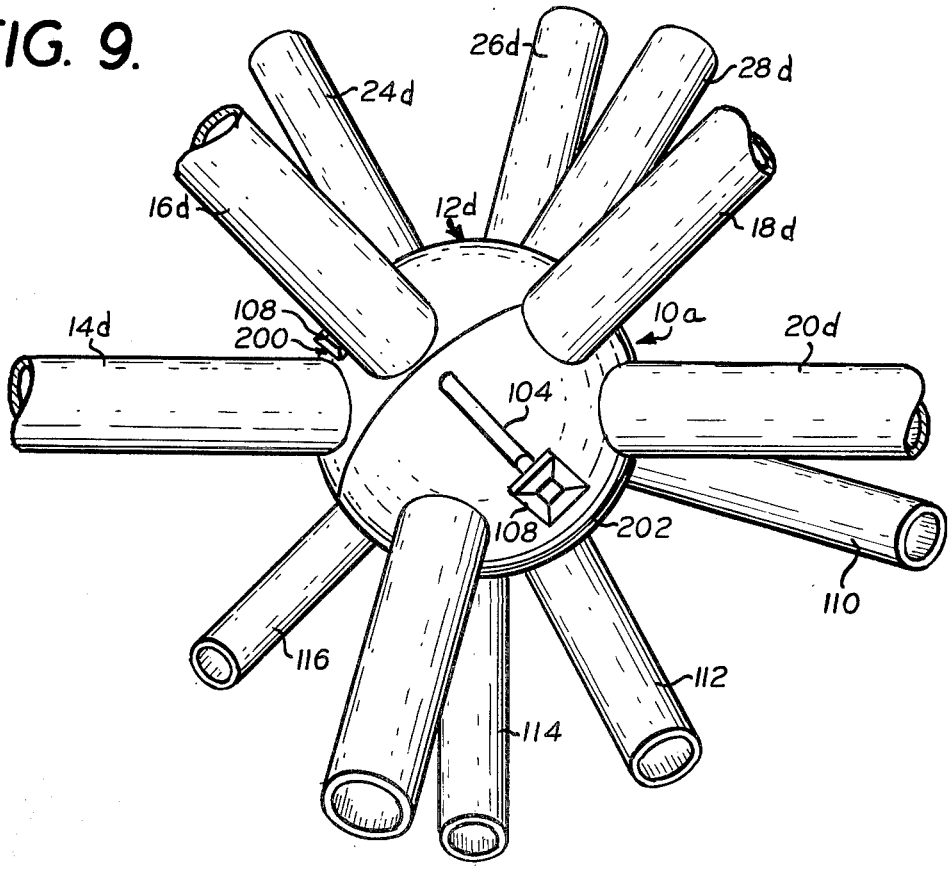
FIG. 9 is an alternative embodiment of the pipe-and-ball joint of FIG. 1 wherein the ball comprises two joinable pipe containing sections.

Now referring to FIG. 9, this figure is identical to FIG. 5 of the aforementioned commonly owned U.S. Pat. No. 3,882,650 and shows an alternative embodiment of the joint 10 illustrated in FIG. 1 as shown and is reproduced herein for purposes of completeness since such joints may, if desired, form the other joints of the truss array 70 which do not comprise the joints associated with the outer chords of the truss array which are employed to support the deck surface 81.

The primary difference between the joint 10 of FIG. 1 and the joint 10*a* of FIG. 9 is that the ball or sphere 12*d* preferably consists of two hemisphere portions 200 and 202 as opposed to the substantially unitary spherical portion 30 and spherical cover portion 32, each of the hemisphere portions 200 and 202 preferably having truss members, preferably identical in configuration to the truss numbers previously described with reference to truss member 20 by way of example, joined thereto in the same fashion, preferably, as truss member 20 is joined to portion 30 of sphere 12. The two hemisphere portions 200 and 202 are preferably bolted together such as by a through bolt 104 and nuts 106 and 108 threadable on the ends of bolt 104. Although only one bolt 104 is shown by way of example, as many additional through bolts as necessary may be utilized to secure the two hemisphere portions 200 and 202 together. In this manner, more truss members may be joined to the resultant sphere 12*d* than in the arrangement previously described with reference to FIG. 1, since all portions of the sphere may have truss members joined thereto, the interior of both hemisphere portions 200 and 202 being accessible for tightening of the nuts on the ends of the inner rod elements of the truss members prior to the bolting of the two hemispheres 200 and 202 together to form the assembled sphere 12*d*. In the preferred embodiment of FIG. 1, the cover portion 32 does not have any truss members extending therefrom and preferably only covers an opening in portion 30 which is only of sufficient size to allow access to the interior of the sphere 12 to enable tightening of the nuts on the inner rod elements. Thus, by way of example, if the sphere 12 of FIG. 1 in an arrangement of the type of FIG. 1 would enable eight truss members to be connected to the sphere 12 the arrangement which is illustrated in FIG. 9 would enable, by way of example, four more truss members to be connected to the sphere 12*d* at the locations where the cover portion 32 was utilized in the arrangement of FIG. 1.

The various elements comprising the preferred truss arrays of the present invention may be formed of a variety of materials, either all the same material or any combination thereof. For example, the outer piping element of the truss members and the spheres may preferably by formed of a material selected from the group consisting of steel of various grades including stainless steel, aluminum, concrete, fiberglass, plastic or wood and the inner rod element of the truss members may be formed of a material selected from the group consisting of steel of various grades including stainless steel, aluminum, fiberglass, plastic or wood.

It should be noted that the truss array need not provide a symmetrical pattern, the location of the truss members being determined by the geometry of the truss modules which are interconnected to transfer the loads to the supports for the truss array. Furthermore, these load transfers occur with the truss array in any orientation, such as horizontal, vertical or at an angle, the load being transferred throughout the truss array to the supports with the tension, compression and shear being transferred from one truss member to the others via the spheres.

It should be also noted that, as previously mentioned, the improved pipe-and-ball truss array of the present invention employing the preferred pipe elements having a structural tee for supporting the deck surface, such as roof decking thereon, provides a truss array which is stronger in bending and which enables ease of assembly or attachment of such decking to the truss array. Moreover, such strengthened support is readily provided with the use of such improved structural tee bearing pipe elements running in only one direction, which preferred direction is the direction normal to the direction in which the roof decking runs so that the balance of the truss array may employ the preferred pipe-and-ball arrangement previously described in commonly owned U.S. Pat. No. 3,882,650.

It is to be understood that the above described embodiments of the invention are merely illustrative of the principles thereof and that numerous modifications and embodiments of the invention may derived within the spirit and scope thereof.

What is claimed is:

1. In a pipe-and-ball truss array for supporting a deck surface thereon in a predetermined plane, said truss array comprising a plurality of truss members, at least one of said plurality of truss members comprising an outer chord of said truss array, at least a first hollow substantially ball-like member portion common to said plurality of truss members and first means for joining said plurality of truss members to said first substantially ball-like member portion, each of said truss members comprising an outer hollow pipe element having a longitudinal axis and first and second ends with an inner rod element extending through said outer hollow pipe element, said inner rod element having first and second ends, said outer hollow pipe element having an outer surface, said first substantially ball-like member portion having a plurality of spaced apart apertures extending from the exterior surface thereof to the interior thereof, each of said inner rod element first ends having threads thereon and extending beyond said outer hollow pipe element first end and through an associated one of said first substantially ball-like member portion apertures, each of said outer hollow pipe element first ends bearing against said first substantially ball-like member portion exterior surface, said first joining means comprising first threadable nut means threadably mounted in said first substantially ball-like member portion interior on said inner rod element threaded first ends and bearing against the interior surface of said first substantially ball-like member portion for simultaneously placing said inner rod element of said truss member in tension and said outer hollow pipe element of the same truss member in compression for enabling applied tensile, compressive and axial forces to be transferrable between said joined truss members through said first substantially ball-like member for maintaining a force resistant three-dimensional prestressed truss array; the improvement comprising a structural tee element extending radially outward from the outer surface of at least one of said outer chord outer hollow pipe elements in a plane normal to the plane in which the deck surface is to be supported on said truss array, said outer chord having a configuration comprising said structural tee element, said structural tee element being structurally integral with said outer chord outer hollow pipe element outer surface and comprising a radially extending portion and a first planar extending portion normal thereto, said first planar extending portion extending in a plane parallel to said deck surface supporting plane and being capable of structurally supporting said deck surface thereon above said structurally integral outer chord outer hollow pipe element outer surface in a single layered support system, said outer chord inner rod element and first joining means being disposed in said outer chord configuration for eccentrically prestressing said outer chord configuration, said other outer hollow pipe elements without said structural tee element having said inner rod element and said first joining means associated therewith disposed for axially prestressing said other outer hollow pipe elements, said eccentrically prestressed outer chord outer hollow pipe element having said structurally integrated radially extending structural tee element being structurally stronger in bending in said force resistant three-dimensional truss array than said other outer hollow pipe elements without said structural tee, whereby said deck surface is structurally supported in said force resistant three-dimensional truss array on said structural tee element bearing pipe elements in said single layered support system.

2. An improved pipe-and-ball truss array in accordance with claim 1 wherein said supported deck surface runs in an associated direction with respect to said truss array and said outer chord outer hollow pipe elements having said radially extending structural tee elements solely extend in a direction normal to said deck surface associated direction.

3. An improved pipe-and-ball truss array in accordance with claim 1 wherein said first planar extending portion is disposed above said substantially ball-like member portion exterior surface, whereby said deck surface is structurally supported in said truss array solely on said structural tee element bearing outer chord pipe elements on said first planar extending portions thereof.

4. An improved pipe-and-ball truss array in accordance with claim 3 wherein said supported deck surface runs in an associated direction with respect to said truss array and said outer chord outer hollow pipe elements having said radially extending structural tee elements solely extend in a direction normal to said deck surface associated direction.

5. An improved pipe-and-ball truss array in accordance with claim 4 wherein said structural tee element radially extending portion radially extends above said first planar extending portion, said structural tee element further comprising a second planar extending portion disposed on said above radially extending portion spaced above and apart from said first planar extending portion and extending in a plane parallel to the plane in which said first planar extending portion extends for supporting said supported deck surface between said first and second planar extending portions.

6. An improved pipe-and-ball truss array in accordance with claim 3 wherein said structural tee element radially extending portion radially extends above said first planar extending portion, said structural tee element further comprising a second planar extending portion disposed on said above radially extending portion spaced above and apart from said first planar extending portion and extending in a plane parallel to the plane in which said first planar extending portion extends for supporting said supported deck surface between said first and second planar extending portions.

7. An improved pipe-and-ball truss array in accordance with claim 2 wherein said structural tee element radially extending portion extends above said first planar extending portion, said structural tee element further comprising a second planar extending portion disposed on said above radially extending portion spaced above and apart from said first planar extending portion and extending in a plane parallel to the plane in which said first planar extending portion extends for supporting said supported deck surface between said first and second planar extending portions.

8. An improved pipe-and-ball truss array in accordance with claim 1 wherein said structural tee element radially extending portion extends above said first planar extending portion, said structural tee element further comprising a second planar extending portion disposed on said radially extending portion spaced above and apart from said first planar extending portion and extending in a plane parallel to the plane in which said first planar extending portion extends for supporting said supported deck surface between said first and second planar extending portions.

9. An improved pipe-and-ball truss array in accordance with claim 8 wherein said above radially extending portion includes a substantially continuous longitudinally extending slot therein, said second planar extending portion being mountable on said radially extending portion through said substantially continuous slot.

10. An improved pipe-and-ball truss array in accordance with claim 1 further comprising at least a second hollow substantially ball-like member portion spaced apart from said first hollow substantially ball-like member portion, said second hollow substantially ball-like member portion having at least one aperture therein extending from the exterior surface thereof to the interior thereof, at least one truss member comprising said structural tee element extending between said first and second hollow substantially ball-like member portions, said one truss member outer hollow pipe element second end bearing against said second hollow substantially ball-like member portion exterior surface, said one truss member inner rod element second end having threads thereon and extending beyond said one truss member outer hollow pipe element second end and through said second hollow substantially ball-like member portion one aperture, said truss array still further comprising second joining means for joining said one truss member to said second substantially ball-like member portion, said second joining means comprising second threadable nut means threadably mounted in said second substantially ball-like member interior on said one truss member inner rod element threaded second end and bearing against the interior surface of said second substantially ball-like member portion for simultaneously placing said inner rod element of said one truss member in tension and said outer hollow pipe element of said one truss member in compression between said first and second substantially ball-like member portions.

11. An improved pipe-and-ball truss array in accordance with claim 10 wherein said structural tee element radially extending portion radially extends above said first planar extending portion, said structural tee element further comprising a second planar portion disposed on said above radially extending portion above and apart from said first planar extending portion and extending in a plane parallel to the plane in which said first planar extending portion extends for supporting said supported deck surface between said first and second planar extending portions.

12. An improved pipe-and-ball truss array in accordance with claim 10 wherein said first planar extending portion is disposed above said substantially ball-like member portion exterior surface, whereby said deck surface is structurally supported in said truss array solely on said structural tee element bearing pipe elements on said first planar extending portions thereof.

13. An improved pipe-and-ball truss array in accordance with claim 10 wherein said hollow substantially ball-like member portions are hollow spherical member portions.

14. An improved pipe-and-ball truss array in accordance with claim 1 wherein said hollow substantially ball-like member portion is a hollow spherical member portion.

15. An improved pipe-and-ball truss array in accordance with claim 14 further comprising at least a second hollow spherical member portion spaced apart from said first hollow spherical member portion, said second hollow spherical member portion having at least one aperture therein extending from the exterior surface thereof to the interior thereof, at least one of said plurality of truss members extending between said first and second hollow spherical member portions, said one truss member outer hollow pipe element second end bearing against said second hollow spherical member portion exterior surface, said one truss member inner rod element second end having threads thereon and extending beyond said one truss member outer hollow pipe element second end and through said second hollow spherical member portion one aperture, said truss array still further comprising second joining means for joining said one truss member to said second spherical member portion, said second joining means comprising threadable nut means threadably mounted in said second spherical member interior on said one truss member inner rod element threaded second end and bearing against the interior surface of said second spherical member portion for simultaneously placing said inner rod element of said one truss member in tension and said outer hollow pipe element of said one truss member in compression between said first and second spherical member portions.

16. An improved pipe-and-ball truss array in accordance with claim 15 further comprising at least one additional truss member, said one additional truss member comprising an outer hollow pipe element having a longitudinal axis and first and second ends and an inner rod element extending through said outer hollow pipe element along said longitudinal axis, said one additional truss member inner rod element having first and second ends, said second spherical member portion having another spaced apart aperture extending from the exterior surface thereof to the interior thereof, said one additional truss member outer hollow pipe element first end bearing against said second hollow spherical member portion exterior surface, said one additional truss member inner rod element first end having threads thereon and extending beyond said one additional truss member outer hollow pipe element first end and through said second hollow spherical member portion other aperture, said truss array still further comprising third joining means for joining said one additional truss member to said second spherical member portion, said third joining means comprising third threadable nut means threadably mounted in said second spherical member interior on said one additional truss member inner rod element threaded first end and bearing against the interior surface of said second spherical member portion for simultaneously placing said inner rod element of said one additional truss member in tension and said outer hollow pipe element of said one additional truss member in compression, whereby applied tensile, compressive and axial forces are transferable between said joining truss members through said spherical members.

17. An improved pipe-and-ball truss array in accordance with claim 16 further comprising at least a third hollow spherical member portion spaced apart from said first and second hollow spherical member portions, said third hollow spherical member portion having at least one aperture therein extending from the exterior surface thereof to the interior thereof, at least said one additional truss member extending between said second and third hollow spherical member portions, said one additional truss member outer hollow pipe element second end bearing against said third hollow spherical member portion exterior surface, said one additional truss member inner rod element second end extending beyond said one additional truss member outer hollow pipe element second end and through said third hollow spherical member portion one aperture and having threads thereon, said truss array still further comprising fourth joining means for joining said one additional truss member to said third spherical member portion, said fourth joining means comprising fourth threadable nut means threadably mounted in said third spherical member interior on said one additional truss member inner rod element threaded second end and bearing against the interior surface of said third spherical member portion for simultaneously placing said inner rod element of said one additional truss member in tension and said outer hollow pipe element of said one additional truss member in compression between said second and third spherical member portions, said first, second and third spherical members and said joined truss members comprising a truss module which is interconnectable with adjacent modules for transferring compressive, tensile and axial loads between said truss members to a support for said truss array.

18. An improved pipe-and-ball truss array in accordance with claim 17 wherein said third spherical member portion includes another spaced apart aperture extending from the exterior surface thereof, at least another of said plurality of truss members extending between said first and third hollow spherical member portions, said other truss member outer hollow pipe element second end bearing against said third hollow spherical member portion exterior surface, said other truss member inner rod element second end having threads thereon and extending beyond said other truss member outer hollow pipe element second end and through said third hollow spherical member portion other aperture, said truss array further comprising fifth joining means for joining said other truss member to said third spherical member portion, said fifth joining means comprising fifth threadable nut means threadably mounted in said third spherical member interior on said other truss member inner rod element threaded second end and bearing against the interior surface of said third spherical member portion for simultaneously placing said inner rod element of said other truss member in tension and said outer hollow pipe element of said other truss member in compression between said first and third spherical member portions, whereby compressive, tensile and axial forces are transferable between said joined truss members through said spherical members.

19. An improved pipe-and-ball truss array in accordance with claim 17 wherein a plurality of said interconnected truss modules comprises a space truss.

20. An improved pipe-and-ball truss array in accordance with claim 17 wherein a plurality of said interconnected truss modules comprises a space frame.

21. An improved pipe-and-ball truss array in accordance with claim 14 wherein said first hollow spherical memeber portion comprises a first hemisphere portion, said truss array further comprises a second hemisphere portion joinable with said first hemisphere portion to form a sphere, second means for joining said first and second hemisphere portions together, at least one additional truss member, and third means for joining said one additional truss member to said second hemisphere portion, said additional truss member comprising an outer hollow pipe element having a longitudinal axis and first and second ends and an inner rod element extending through said outer hollow pipe element along said longitudinal axis, said inner rod element having first and second ends, said second hemisphere portion having at least one aperture extending from the exterior surface thereof to the interior thereof, said one additional truss member inner rod element first end having threads thereon and extending beyond said one additional truss member outer hollow pipe element first end through said second hemisphere portion one aperture, said one additional truss member outer hollow pipe element first end bearing against said second hemisphere portion exterior surface, said third joining means comprising second threadable nut means threadably mounted in said second hemisphere portion interior on said one additional truss member inner rod element threaded first end and bearing against the interior surface of said second hemisphere portion for simultaneously placing said inner rod element of said one additional truss member in tension and said one additional truss member outer hollow pipe element in compression, whereby applied tensile, compressive and axial forces are transferrable between said joined truss member including said one additional truss member through said joined first and second hemisphere portions.

22. An improved pipe-and-ball truss array in accordance with claim 21 wherein said first and second hemisphere portions each include at least one additional aperture extending from the exterior surface thereof to the interior thereof, said second joining means comprising third nut means extending through both said first and second hemisphere portion additional apertures.

23. An improved pipe-and-ball truss array in accordance with claim 14 wherein at least one of said plurality of truss members has at least a different outer diameter for said outer hollow pipe element than another one of said plurality of truss members, said outer diameter being at least dependent on the compressive load to be carried by said truss member, said one truss member and said other truss member at least carrying different compressive loads.

24. An improved pipe-and-ball truss array in accordance with claim 14 wherein at least one of said plurality of truss members has at least a different thickness for said outer hollow pipe element than another one of said plurality of truss members said thickness being at least dependent on the compressive load to be carried by said truss member, said one truss member and said other truss member at least carrying different compressive loads.

25. An improved pipe-and-ball truss array in accordance with claim 14 wherein at least one of said plurality of truss members has at least a different diameter inner rod element than another one of said plurality of truss members, said diameter being at least dependent on the tensile load to be carried by said truss member, said one truss member and said other truss member at least carrying different tensile loads.

26. An improved pipe-and-ball truss array in accordance with claim 14 further comprising spacer means within the interior of each of said outer hollow pipe elements for supporting said associated inner rod element within said associated outer hollow pipe element.

27. An improved pipe-and-ball truss array in accordance with claim 14 wherein said outer hollow pipe element is formed from a material selected from the group consisting of steel, aluminum, concrete, wood, fiberglass and plastic; said spherical member is formed from a material selected from the group consisting of steel, aluminum, concrete, wood, fiberglass and plastic; and said inner rod element is formed from a material selected from the group consisting of steel, aluminum, wood, fiberglass, and plastic.

* * * * *